US010107587B2

(12) United States Patent
Skelton

(10) Patent No.: US 10,107,587 B2
(45) Date of Patent: Oct. 23, 2018

(54) GRIP ATTACHMENT FOR A FIREARM

(71) Applicant: James Levoyd Skelton, Huntsville, AL (US)

(72) Inventor: James Levoyd Skelton, Huntsville, AL (US)

( * ) Notice: Subject to any disclaimer, the term of this patent is extended or adjusted under 35 U.S.C. 154(b) by 0 days.

(21) Appl. No.: 15/040,264

(22) Filed: Feb. 10, 2016

(65) Prior Publication Data

US 2016/0238340 A1 Aug. 18, 2016

Related U.S. Application Data

(60) Provisional application No. 62/116,100, filed on Feb. 13, 2015.

(51) Int. Cl.

| | |
|---|---|
| ***F41C 23/20*** | (2006.01) |
| ***F41C 23/16*** | (2006.01) |
| ***F41A 19/09*** | (2006.01) |
| ***F41C 23/10*** | (2006.01) |

(52) U.S. Cl.

CPC ..... *F41C 23/16* (2013.01); *F41A 19/09* (2013.01); *F41C 23/10* (2013.01); *F41C 23/20* (2013.01)

(58) Field of Classification Search

CPC ..... F41C 23/00; F41C 23/12; F41C 23/20; F41A 19/10

USPC ..... 42/71.01, 72, 73, 74, 94; 89/136

See application file for complete search history.

(56) References Cited

U.S. PATENT DOCUMENTS

| | | | | |
|---|---|---|---|---|
| 8,127,658 | B1 * | 3/2012 | Cottle | F41A 19/11 42/69.01 |
| 8,176,835 | B1 * | 5/2012 | Cottle | F41A 19/11 42/69.01 |
| 8,459,171 | B2 * | 6/2013 | Cottle | F41A 19/06 42/94 |
| 8,474,169 | B2 * | 7/2013 | Cottle | F41C 23/04 42/73 |
| D700,943 | S * | 3/2014 | Cottle | D22/108 |
| D701,281 | S * | 3/2014 | Cottle | D22/108 |
| D710,477 | S * | 8/2014 | Kauranen | D22/108 |
| D710,478 | S * | 8/2014 | Kauranen | D22/108 |
| 2011/0113665 | A1 * | 5/2011 | Cottle | F41C 23/04 42/73 |
| 2012/0311907 | A1 * | 12/2012 | Cottle | F41A 19/11 42/71.01 |
| 2013/0074685 | A1 * | 3/2013 | Cottle | F41A 19/06 89/27.11 |
| 2016/0061548 | A1 * | 3/2016 | Urias | F41A 11/02 42/69.01 |
| 2016/0187099 | A1 * | 6/2016 | Cottle | F41C 23/14 42/73 |

* cited by examiner

*Primary Examiner* — Jonathan C Weber
(74) *Attorney, Agent, or Firm* — George P Kobler

(57) ABSTRACT

A grip attachment for a firearm includes a hollow grip cover for receiving the firearm rear hand grip and having an expansion slit defined in a lateral side thereof and an arm extending to the rear of the grip cover. The arm includes an attachment ring for receiving the firearm butt stock extension tube in sliding engagement and a butt stock coupling disposed at a rearward end of the arm for coupling the rearward end of said grip attachment to the firearm butt stock. The butt stock coupling comprises a rearward extending wedge for preventing engagement of the firearm butt stock locking mechanism.

19 Claims, 7 Drawing Sheets

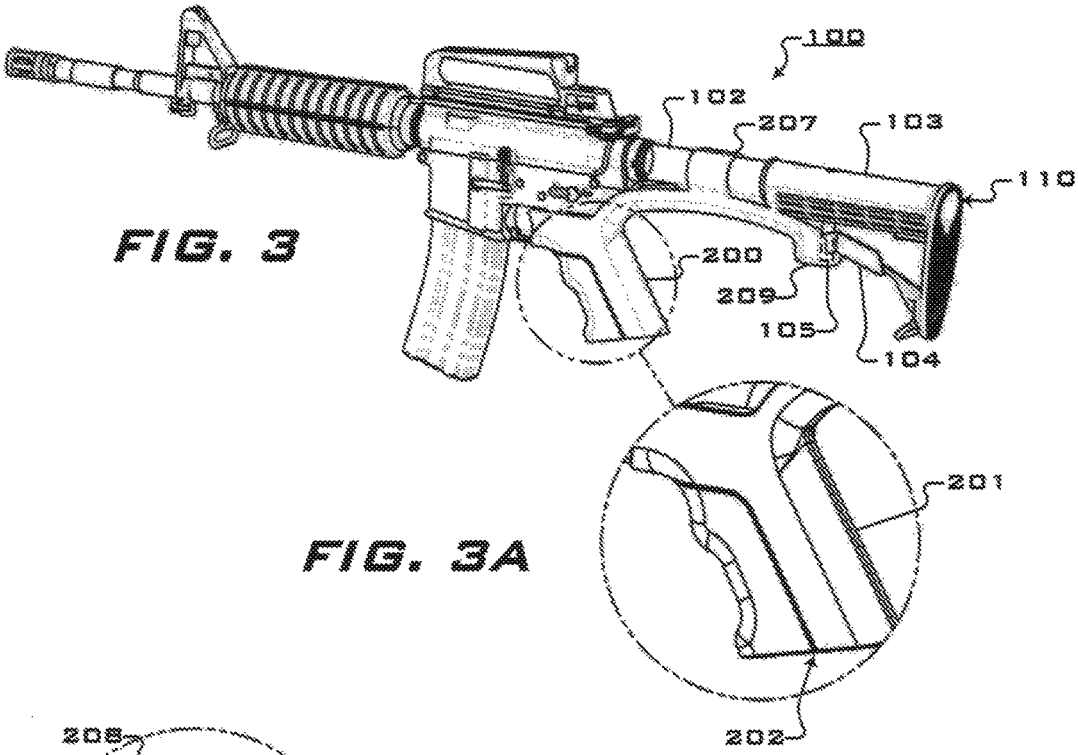
FIG. 3
FIG. 3A
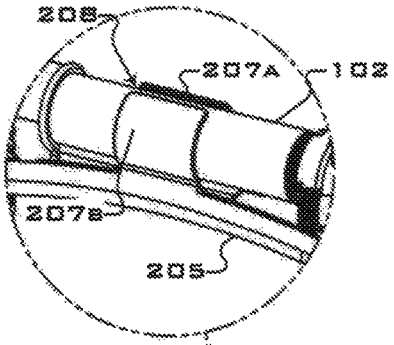
FIG. 4A
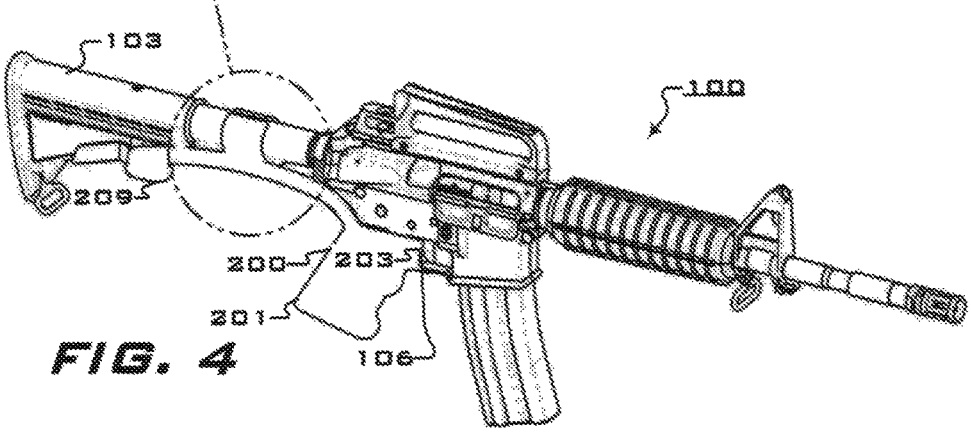
FIG. 4

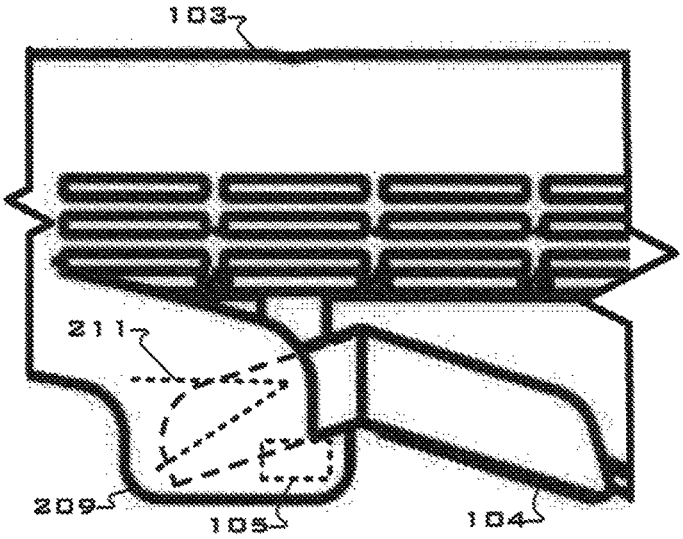
FIG. 5E
FIG. 7A
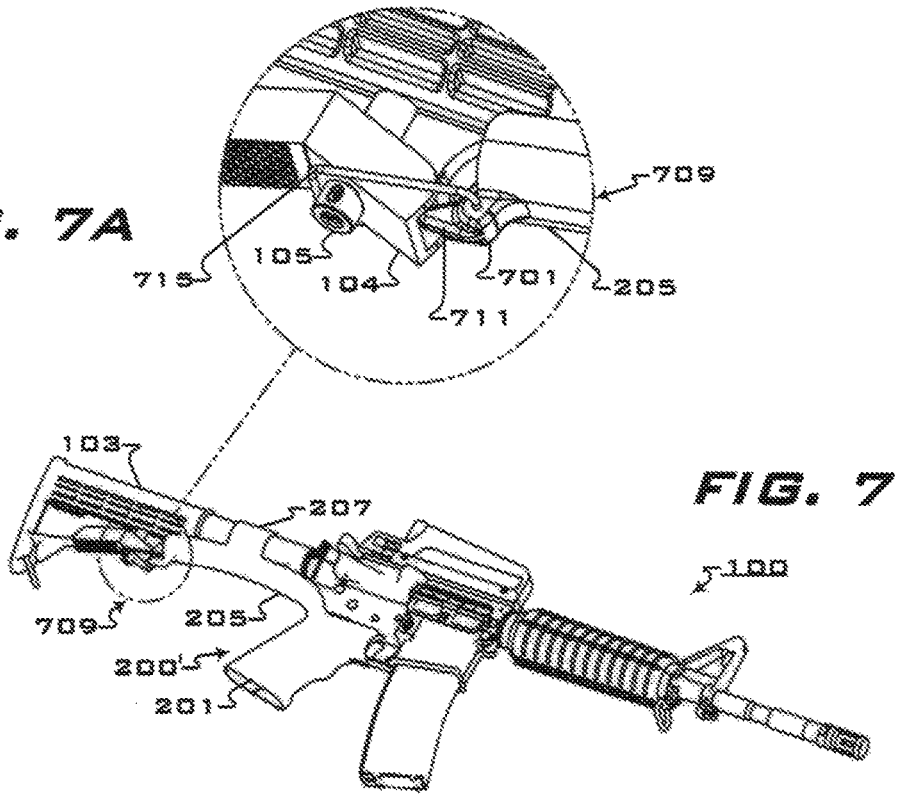
FIG. 7

GRIP ATTACHMENT FOR A FIREARM

CROSS-REFERENCE TO RELATED APPLICATIONS

This application claims the benefit of priority under 35 U.S.C. § 120 of U.S. Provisional Application No. 61/116,100, filed Feb. 13, 2015, which is incorporated by reference as if fully set forth herein,

BRIEF DESCRIPTION OF THE DRAWINGS

A grip attachment for a firearm is described with reference to the accompanying drawings. In the drawings, like reference numbers indicate identical or functionally similar elements. Additionally, the left-most digit(s) of a reference number identifies the drawing in which the reference number first appears.

Figure 2A:
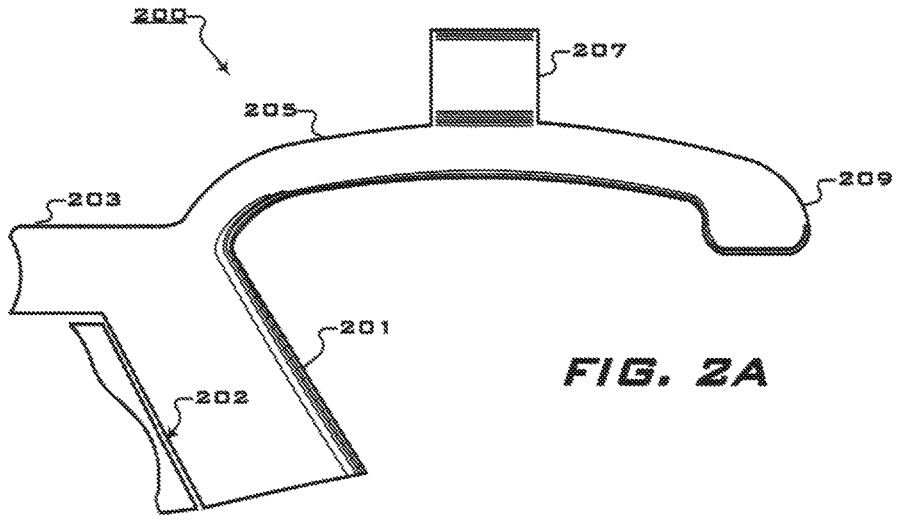
Figure 2B:
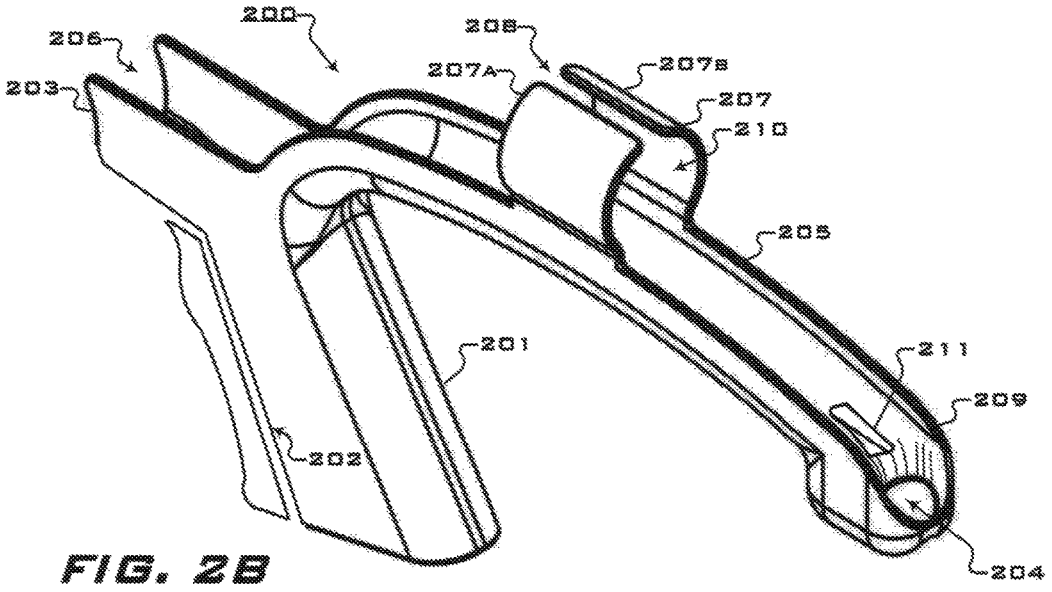
Figure 2C:
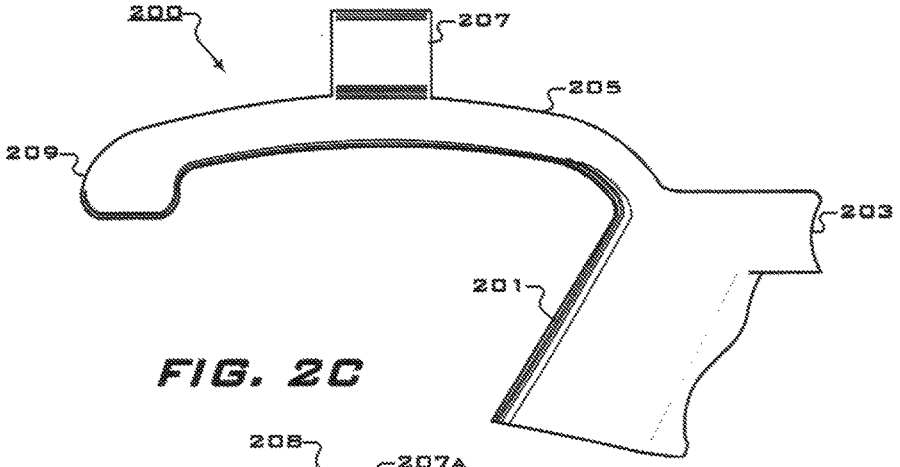
Figure 2D:
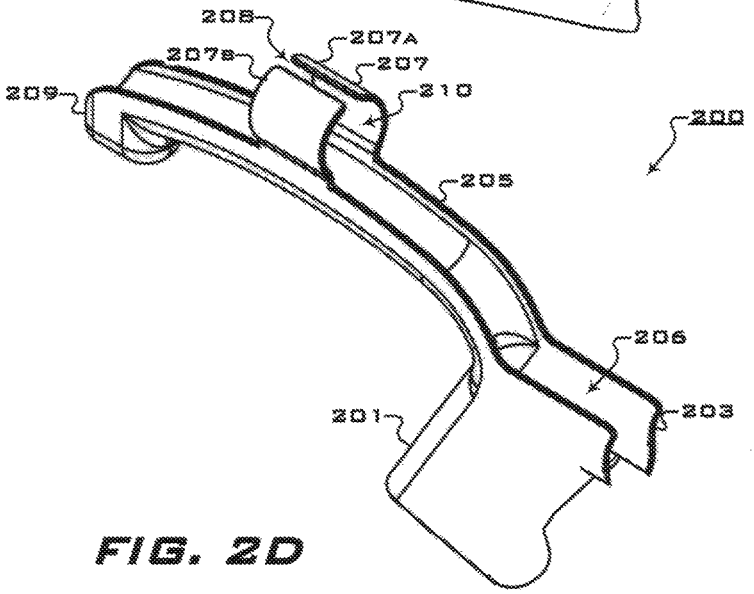
Figure 2E:
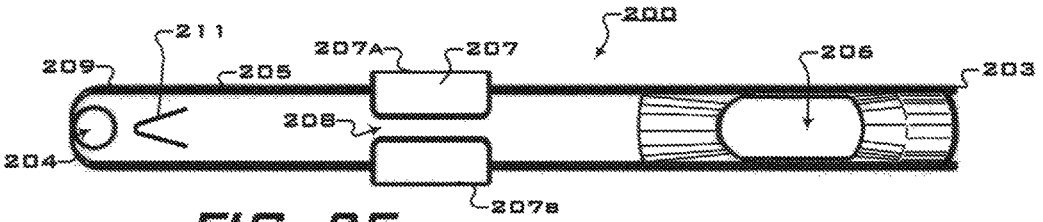
Figure 6A:
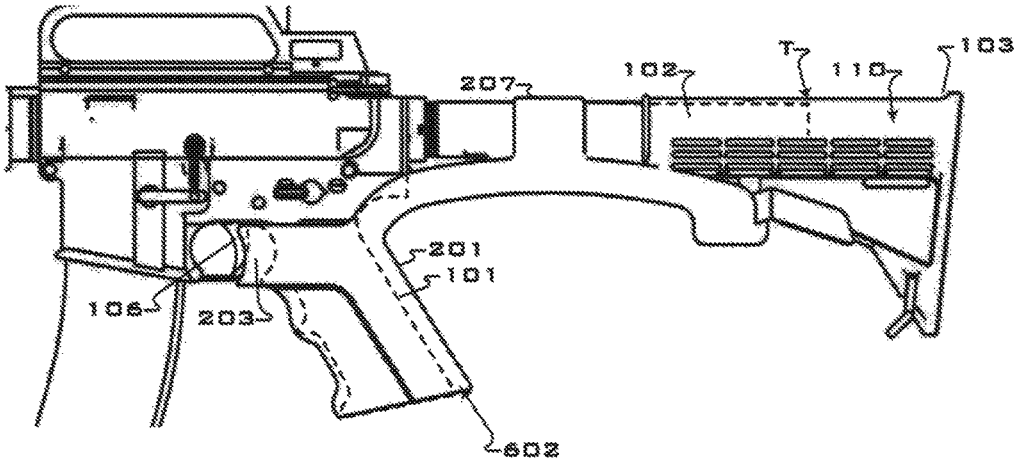
Figure 6B:
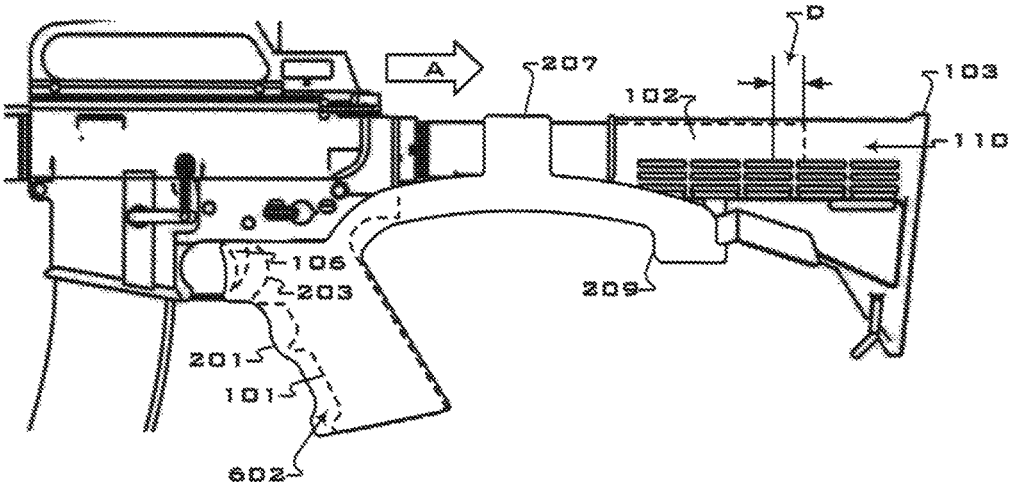

FIG, 2A is a left elevation view of an exemplary grip attachment;

FIG. 2B is a left rear perspective view of the exemplary grip attachment of FIG. 2A;

FIG. 2C is a right elevation view of the exemplary grip attachment of FIG. 2A;

FIG. 2D is a front light perspective view of the exemplary grip attachment of FIG. 2A;

FIG. 2E is a top plan view of the exemplary grip attachment of FIG. 2A;

FIG. 3 illustrates an exemplary grip attachment attached to a firearm;

FIG. 3A is an detailed view of an exemplary grip cover as attached to a firearm;

FIG. 4 depicts the exemplary grip attachment attached to a firearm from the right perspective;

FIG. 4A is a detailed view of the attachment ring of the exemplary grip attachment engaged with the firearm extension tube;

FIGS. 5A through 5D show the process of attaching the exemplary grip attachment to a firearm;

FIG. 5E is a detailed, fragmentary view showing engagement of the exemplary grip coupling with the firearm release lever;

FIG. 6A illustrates an exemplary grip attachment as installed on a firearm in a pre-firing position;

FIG. 6B illustrates the exemplary grip attachment as installed on a firearm showing recoil of the firearm just alter firing;

FIG. 7 shows an alternative embodiment of the exemplary grip attachment as installed on a firearm; and FIG. 7A is a detailed view of the rearward coupling according to the alternative embodiment.

DETAILED DESCRIPTION

The various embodiments of the grip attachment for a firearm and their advantages are best understood by referring to FIGS. 1 through 7A of the drawings. The elements of the drawings are not necessarily to scale, emphasis instead being placed upon clearly illustrating the novel features and principles of operation. Throughout the drawings, like numerals are used for Like and corresponding parts of the various drawings.

Reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment" "in another embodiment," or variations thereof in various places throughout the specification are not necessarily all referring to its respective embodiment.

Figure 1:
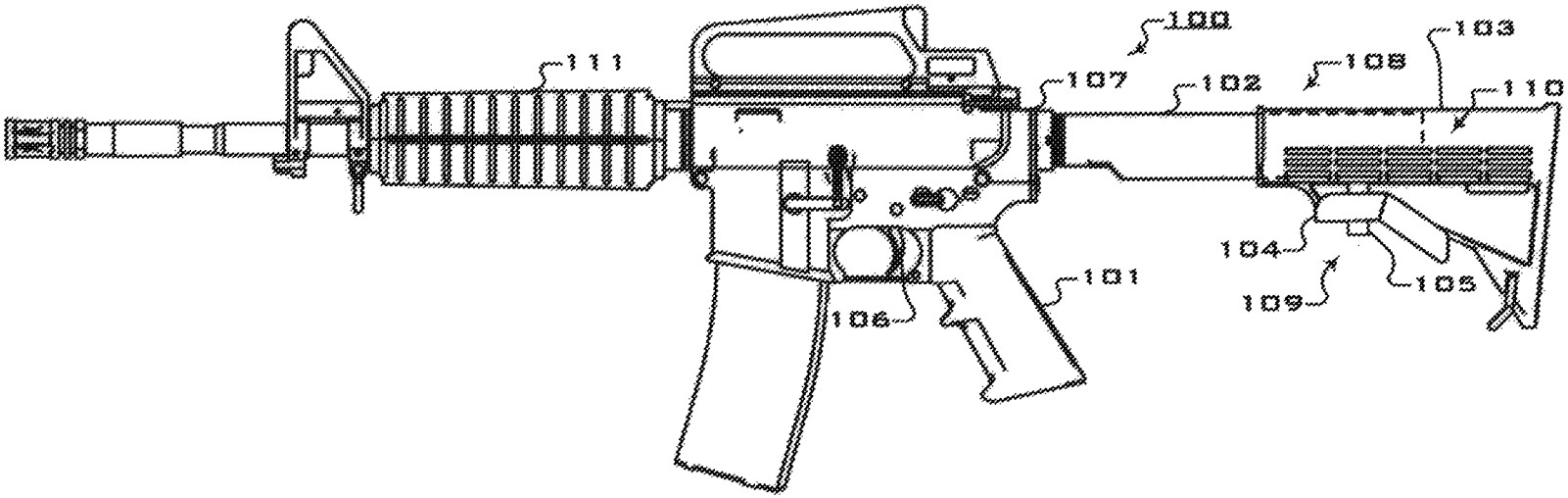
FIG. 1 depicts a typical firearm with which an exemplary grip attachment may be used.

For purposes of description herein, the terms "upper," "lower," "right," "left," "rear," "front," "vertical," "horizontal," and derivatives thereof shall relate to the firearm 100 illustrated in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 presents a topical firearm 100 with which an embodiment of the novel grip attachment may be used. The firearm 100, in pertinent part, comprises a rear hand grip 101 extending downward from a receiver assembly 107 and a trigger 106 disposed such that an operator gripping the hand grip 101 may operate the trigger 106 with his or her index finger. The firearm 100 further includes a stock assembly 108 comprising an extension tube 102 having a forward end attached to the rear end of the receiver assembly 107. A butt stock 103 is slidably engaged with the tube 102 and comprises a chamber 110 for slidably receiving the tube 102. The butt stock 103 may be positioned longitudinally along the extension tube 102 and is configured with a locking mechanism 109 to allow the operator to fix the longitudinal position of the butt stock 103. The locking mechanism 109 comprises a spring-biased release lever 104 coupled to a locking pin 105 having a lower end portion extending downward from the butt stock 103. The release lever 105 is spring-biased to a locked position. The butt stock 103 may be longitudinally positioned along the extension tube 102 by depressing the rear end of the release lever 104 which disengages the locking pin 105 from any of a plurality of detents (not shown) formed in the underside of the extension tube 102. The butt stock 103 may then be slid forward or backward along the tube 102 to a desired position. Releasing the lever 104 allows the locking pin 105 to engage a detent, locking the butt stock 103 in the desired position. The firearm 100 also includes a forward grip 111.

Referring now to FIGS. 2A through 2E, an attachable grip 200 for such a firearm 100 comprises a grip cover 201 in which is defined a slit 202 that creates an expansion joint that allows the grip cover 201 to expand outwardly. The grip cover 201 defines a hollow chamber 206 for receiving the hand grip 101 of the firearm 100 as will be described in greater detail below. A trigger guard 203 extends forward from the upper portion of the grip attachment 200 and an arm 205 extends to the rear from the upper portion of the grip cover 201. An extension tube 102 attachment ring 207 is disposed roughly midway along the arm 205 having opposing arcuate flanges 207*a, b* extending generally vertically upward with a longitudinally-oriented slot 208 defined between the opposing upward ends of the flanges 207*a, b*. Thus, a generally cylindrical channel 210 is formed between the opposing flanges 207*a, b* that is dimensioned to receive the extension tube 102.

The rearward end of the arm 205 is formed to comprise a butt stock coupling 209 for coupling the grip 200 to the butt stock 103. In the present embodiment, the butt stock coupling 209 is configured with a wedge 211 extending to the rear from the arm 205 near the end thereof and a recess 204 defined in the lower rearward end of the coupling 209.

The grip attachment 200 is preferably integrally-formed, meaning it may be a single-piece molded article, and preferably comprises a stiff, but resilient material with a relatively high degree of shape memory. Alternatively, the grip attachment may be formed of separate molded pieces attached together to form a single-piece article through means now known in the art, e.g., welding, or hereafter developed.

FIGS. 5A through 5D show attachment of the grip 200 to a firearm 100. The grip cover 201 is slid over the firearm hand grip 101, inserting the hand grip 101 into the hollow chamber 206 defined in the grip cover 201. To accommodate the hand grip 101, slit 202 is allowed to open slightly (FIG. 5C) as the hand grip 101 is inserted into the chamber 206 and closes again due to resiliency of the material out of which the grip attachment 200 is formed. Roughly at the same time, extension tube attachment ring 207 is attached to the extension tube 102 by pressing tube 102 into the slot 208 between the attachment ring flanges 207*a, b* forcing the flanges 207*a, b* to diverge until the tube 102 fully passes through the slot 208 whereupon the flanges 207*a, b*, due to shape memory of the material out of which the grip attachment 200 is formed, close again to encircle the extension tube 102 and the tube is seated within the cylindrical channel 210 (FIG. 4A). The attachment ring 207 is configured to allow the extension tube 102 to slide longitudinally within the cylindrical channel 210.

Figure 5A:
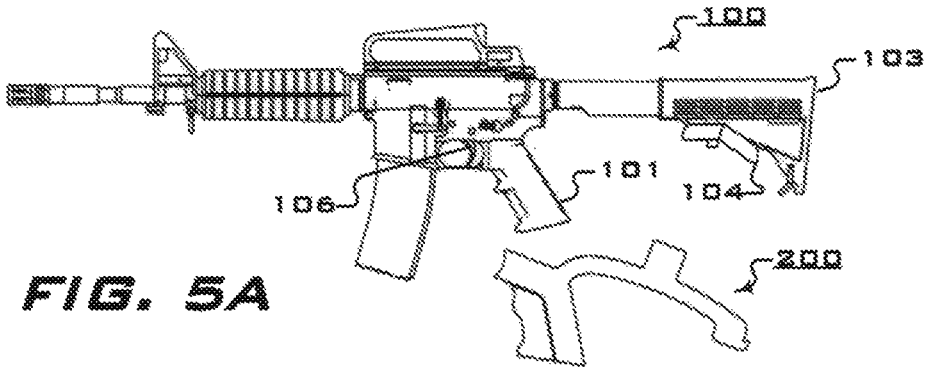
Figure 5B:
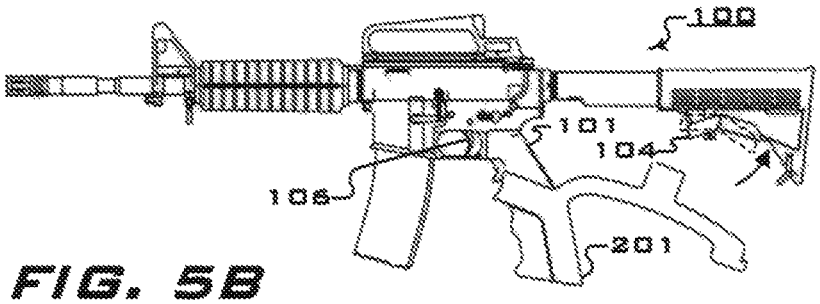
Figure 5C:
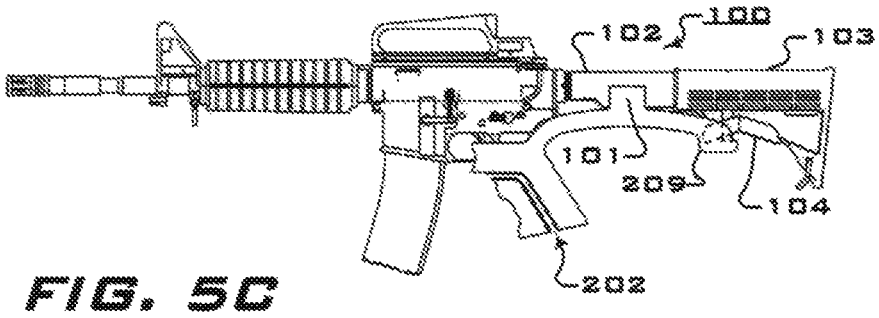
Figure 5D:
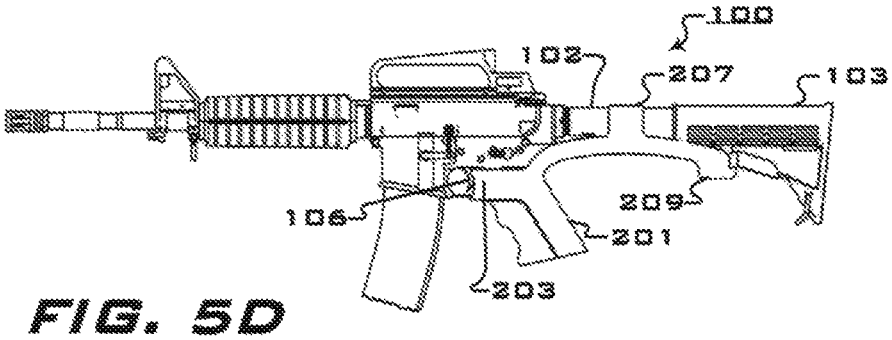

As shown in FIG. 5B, release lever 104 is depressed to withdraw the locking pin 105 and allow the butt stock 103 to slide freely along the extension tube 102. As best seen in FIG. 5E, the coupling 209 is placed over the exposed end of the locking pin 105 inserting the wedge 211 above the forward end of the release lever 104 preventing the release lever 104 from rocking upward and reinserting the locking pin 105 in the detents in the extension cube 102. The free end of the locking pin 105 is then seated within the recess 204 defined in the rearward end of the coupling 209. Accordingly, the rearward end of the grip attachment 200 is coupled to the firearm's butt stock 103 while the butt stock 103 is allowed to slide longitudinally along the extension tube 102 to a degree limited by the length of the grip attachment 200.

FIGS. 6A & B serve to illustrate how operation of the firearm 100 with the grip attachment 200 installed produces an increased firing rate of the firearm 100. FIG. 6A shows the firearm 100 with grip attachment 200 in a pre-firing position. The grip cover 201 is dimensioned such that when the hand grip 101 is seated within the grip cover 201, a space 602 exists between the rear interior wall of the grip cover 201 and the rear side of the hand grip 101. Also in the pre-firing position, the trigger 106 appears slightly forward of the front edge of the trigger guard 203, allowing activation of the trigger 106 for firing, while the position of the rearward end of the extension tube 102 relative to the butt stock 103 is at reference point T.

Firing the weapon 100 may be performed in the conventional manner with the user's forward hand on the forward hand grip 111, the rear hand over the grip cover 201 with the index finger to depress the trigger 106 and the firearm urged rearward such that the rearward end of the butt stock 103 is seated against the user's shoulder. It should be noted that prior solutions using a "bump-fire" technique to increasing firing rate require that the forward arm is used to pull the firearm 100 forward, which technique is undesirable because it tends to reduce accuracy. Using this grip attachment 200, it is not necessary to urge the firearm 100 forward to achieve the increased rate of fire. On the contrary, the firearm 100 may be held in a normal position relative to the user with the grip attachment 200 and, thus, the butt stock 103 held stationary. Then, to fire, the user depresses the trigger 106 with a trigger finger, which activates firing of a round, keeping the trigger finger held against the forward edge of the trigger guard 203.

FIG. 6B shows the longitudinal position of the firearm 100 with respect to the grip attachment 200 and butt stock 103 just after firing where recoil of the firearm 100 forces the firearm to the rear as shown by reference arrow A. As the firearm 100 moves rearward, the extension tube 102 slides rearward relative to the grip attachment 200 within the cylindrical channel 210 of the attachment ring 207. Since the butt stock 103 is disengaged from the extension tube 102, the tube 102 slides within the chamber 110 to the rear by some distance "D" relative to the butt stock 103 which maintained stationary by virtue of being coupled to the grip attachment 200. At the same time, the hand grip 101 moves rearward inside the hollow chamber 206 of the grip cover 201 some distance denned by the space 602 between the hand grip 101 and the grip cover 201 interior walk and the trigger 106 is moved to the roar of the forward edge of the trigger guard 203 which prevents the users trigger finger from engaging the trigger 106 further. Consequently, the trigger 106 is allowed to reset and the firearm is able to be fired again. Thereafter, the firearm 100 moves forward again the pre-firing position of FIG. 6A and the trigger 106 is forced against the user's trigger finger that is held against the forward edge of the trigger guard 203, thus actuating the trigger 106 and the firing sequence is initiated again.

An alternative embodiment of the grip attachment 200' is shown in FIGS. 7 & 7A. In this embodiment, butt stock coupling 709 comprises a free rearward end from which a wedge 711 extends to the rear. A D-ring 702 is pivotally attached to the forward portion of the wedge 711. When attaching the grip attachment 200' to the firearm 100, the wedge 711 is inserted into the forward end of the release lever 104 to prevent it from closing the locking pin 105 in a detent in the extension tube 102. The d-ring 702 is swung rearward to engage the free downward end of the locking pin 105, thus, coupling the rearward end of the grip attachment 200' to the butt stock 103 leaving the butt stock 103 able to slide longitudinally with respect to the extension tube 102 as described above.

As described above and shown in the associated drawings, the present invention comprises a grip attachment for a firearm. While particular embodiment Have been described, it will be understood, however, that any invention appertaining to the grip attachment described is not limited thereto, since modifications may be made by those skilled in the art, particularly in light of the foregoing teachings. It is, therefore, contemplated by the appended claims to cover any such modifications that incorporate those features or those improvement that embody the spirit and scope of the invention.

What is claimed is:

1. A grip attachment for a firearm, the firearm having a receiver assembly, a trigger, a rear hand grip, and a stock assembly comprising an extension tube extending to the rear of the receiver assembly and a butt stock slidably engaged therewith, the butt stock having a locking mechanism for selectively locking the longitudinal position of the butt stock with respect to the extension tube, said grip attachment comprising:

a hollow grip cover for receiving the firearm rear hand grip and having an expansion slit defined in a lateral side thereof;

a trigger guard extending forward from a top portion of said grip cover;

an arm extending to the rear of said grip cover;

an extension tube attachment ring for receiving the extension tube in sliding engagement, said attachment ring disposed on the top of said arm along the length thereof; and a butt stock coupling disposed at a rearward end of said arm for coupling the rearward end of said grip attachment to the firearm butt stock, said butt stock coupling comprising a rearward extending wedge for preventing engagement of the firearm butt stock locking mechanism.

2. The grip attachment of claim 1, wherein said hollow grip cover is dimensioned such that when the firearm rear hand grip is inserted therein, a space is defined therein between an interior wall of said grip cover and the rear surface of the rear hand grip.

3. The grip attachment of claim 1, wherein said butt stock coupling is configured with a recess for coupling the rear end of said grip attachment with the firearm butt stock.

4. The grip attachment of claim 3, wherein said hollow grip cover is dimensioned such that when the firearm rear hand grip is inserted therein, a space is defined therein between an interior wail of said grip cover and the rear surface of the rear hand grip.

5. The grip attachment of claim 1, wherein said butt stock coupling is configured with a d-ring for coupling the rear end of said grip attachment with the firearm but stock.

6. The grip attachment of claim 5, wherein said hollow grip cover is dimensioned such that when the firearm rear hand grip is inserted therein, a space is defined therein between an interior wall of said grip cover and the rear surface of the rear hand grip.

7. The grip attachment of claim 1, wherein said attachment ring comprises opposing arcuate flanges extending upward from said arm having opposing upward ends that defined an expansion slot therebetween, said arcuate flanges defining a cylindrical channel between them dimensioned to receive the firearm extension tube in sliding engagement.

8. The grip attachment of claim 7, wherein said hollow grip cover is dimensioned such that when the firearm rear hand grip is inserted therein, a space is defined therein between an interior wail of said grip cover and the rear surface of the rear hand grip.

9. The grip attachment of claim 7, wherein said butt stock coupling is configured with a recess for coupling the rear end of said grip attachment with the firearm butt stock.

10. The grip attachment of claim 9, wherein said hollow grip cover is dimensioned such that when the firearm rear hand grip is inserted therein, a space is defined therein between an interior wall of said grip cover and the rear surface of the rear hand grip.

11. The of claim 7, wherein said butt stock coupling is configured with a d-ring for coupling the rear end of said grip attachment with the firearm butt stock.

12. The grip attachment of claim 11, wherein said hollow grip cover is dimensioned such that when the firearm rear hand grip is inserted therein, a space is defined therein between an interior wall of said grip cover and the rear surface of the rear hand grip.

13. The grip attachment of claim 1, wherein said grip attachment is an integrally formed unitary article.

14. The grip attachment of claim 13, wherein said hollow grip cover is dimensioned such that when the firearm rear hand grip is inserted therein, a space is defined therein between an interior wail of said grip cover and the rear surface of the rear hand grip.

15. The grip attachment of claim 13, wherein said butt stock coupling is configured with a recess for coupling the rear end of said grip attachment with the firearm butt stock.

16. The grip attachment of claim 15, wherein said hollow grip cover is dimensioned such that when the firearm rear hand grip is inserted therein, a space is defined therein between an interior wall of said grip cover and the rear surface of the rear hand grip.

17. The grip attachment of claim 13, wherein said butt stock coupling is configured with a d-ring for coupling the rear end of said grip attachment with the firearm butt stock.

18. The grip attachment of claim 17, wherein said hollow grip cover is dimensioned such that when the firearm rear hand grip is inserted therein, a space is defined therein between an interior wall of said grip cover and the rear surface of the rear hand grip.

19. The grip attachment of claim 1, wherein the extension tube attachment ring is disposed on the top of said arm midway along the length thereof.

* * * * *